United States Patent [19]

Seki

[11] 4,427,146

[45] Jan. 24, 1984

[54] BUTTON ORIENTING AND PLACING APPARATUS

[75] Inventor: Fumio Seki, Toyama, Japan

[73] Assignee: Yoshida Kogyo K. K., Tokyo, Japan

[21] Appl. No.: 366,844

[22] Filed: Apr. 9, 1982

[30] Foreign Application Priority Data

Apr. 22, 1981 [JP] Japan ..... 56-58450[U]

[51] Int. Cl.[3] ..... A41H 37/10

[52] U.S. Cl. ..... 227/119

[58] Field of Search ..... 227/117, 118, 119, 155

[56] References Cited

U.S. PATENT DOCUMENTS

| | | | |
|---|---|---|---|
| 2,588,486 | 3/1952 | Clarke | 227/119 |
| 3,815,805 | 6/1974 | Beneteau | 227/119 |
| 4,019,666 | 4/1977 | Foults | 227/119 |

*Primary Examiner*—Paul A. Bell

*Attorney, Agent, or Firm*—Bucknam and Archer

[57] ABSTRACT

An apparatus for orienting and placing a button for attachment to a garment comprises a guide having a button guide channel, and a spring-biased locking lever pivotable on a button pushing slide slidably mounted on the guide. The pushing slide has a stepped end portion engageable at its tip end with the button head on its peripheral edge. The locking lever has a flanged end portion extending beyond the stepped end portion and terminating in a pair of claws for catching therebetween a tab disposed on the reverse side of the button head. The guide channel is defined by a side wall and a friction member. The friction member has a frictional surface tangentially engageable with the button head for causing the button to turn or roll, when the latter is pushed by the pushing lever in the guide channel, until the tab of the button is catched by the claws.

3 Claims, 6 Drawing Figures

BUTTON ORIENTING AND PLACING APPARATUS

BACKGROUND OF THE INVENTION

1. Field of the Invention

The present invention relates to a machine for attaching fasteners such as buttons to a garment, and more particularly to an apparatus for orienting and placing buttons one at a time for attachment to a garment.

2. Prior Art

Machines for attaching buttons to a garment are known in which one button and its mating fastener part at a time are delivered from their respective chutes to a coacting punch and die and are then clinched or coupled together by the punch and die with a garment placed therebetween. If the button bears on its obverse side a design, mark or symbol indicative of a specified angular position in which the button is to be mounted on a garment, the button must be oriented in such direction.

Japanese Patent Laid-Open Publication (Kokai) 52-60740 (corresponding to U.S. Pat. No. 4,019,666) discloses a button orienting apparatus which includes a pusher mechanism for pushing a button to turn or roll the same by a pushing slide in the guide channel until a tab on the reverse side of the button is caught by a pair of claws on a locking lever mounted on the pushing slide. The problem with the prior apparatus is that since the button is pushed on its shank by a bifurcated end of the pushing slide which end projects beyond the clawed end of the locking lever, the button tends to be forwardly tilted as it is moved in the guide channel. With this arrangement, smooth and exact orientation of the button is difficult to achieve. Further, in the prior apparatus, a friction member for causing the button to roll has an inwardly inclined frictional surface engageable with a peripheral edge portion of the button head on its reverse side. Accordingly, the button head is pressed against the bed of the guide channel and also against a side wall opposite to the friction member, thus increasing the resistance to turning of the button. With this increased resistance, smooth rolling of the button in the guide channel is difficult to achieve.

SUMMARY OF THE INVENTION

According to the present invention, a pushing mechanism, for pushing a button through and out of a guide channel, includes a button pushing slide slidably supported on a guide defining a guide channel, and a spring-biased locking lever pivotally mounted on the slide. The pushing slide has a stepped end portion engageable at its tip end with the head of the button on its peripheral edge. The locking lever has a flanged end portion extending beyond the stepped end portion and terminating in a pair of downwardly directed claws for catching therebetween a tab disposed on the reverse side of the button head. The guide channel is defined by a side wall and a friction member which are disposed opposite to one another. The side wall has an inwardly directed flange engageable with a shank of the button in the guide channel. The friction member has a frictional surface tangentially engageable with the button head at a right angle to the general plane thereof.

It is therefore an object of the invention to provide a button orienting and placing apparatus by which a button can be moved through a guide channel smoothly without being forwardly tilted.

Another object of the invention is to provide a button orienting and placing apparatus which enables easy and exact orientation of a button.

Other objects and advantages will appear from the following description of an example of the invention, when considered in connection with the accompanying drawings, and the novel features will be particularly pointed out in the appended claims.

DETAILED DESCRIPTION

Figure 1:
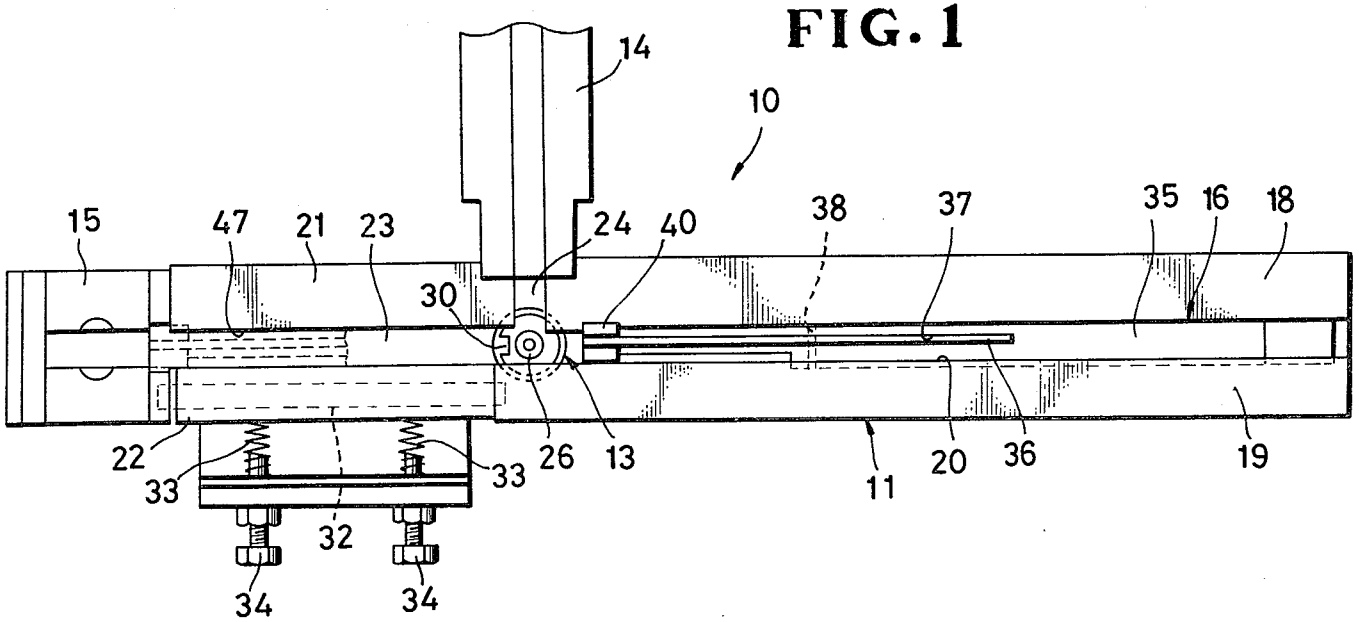
FIG. 1 is a plan view of a button orienting and placing apparatus according to the present invention, with a chute fragmentarily shown.
Figure 2:
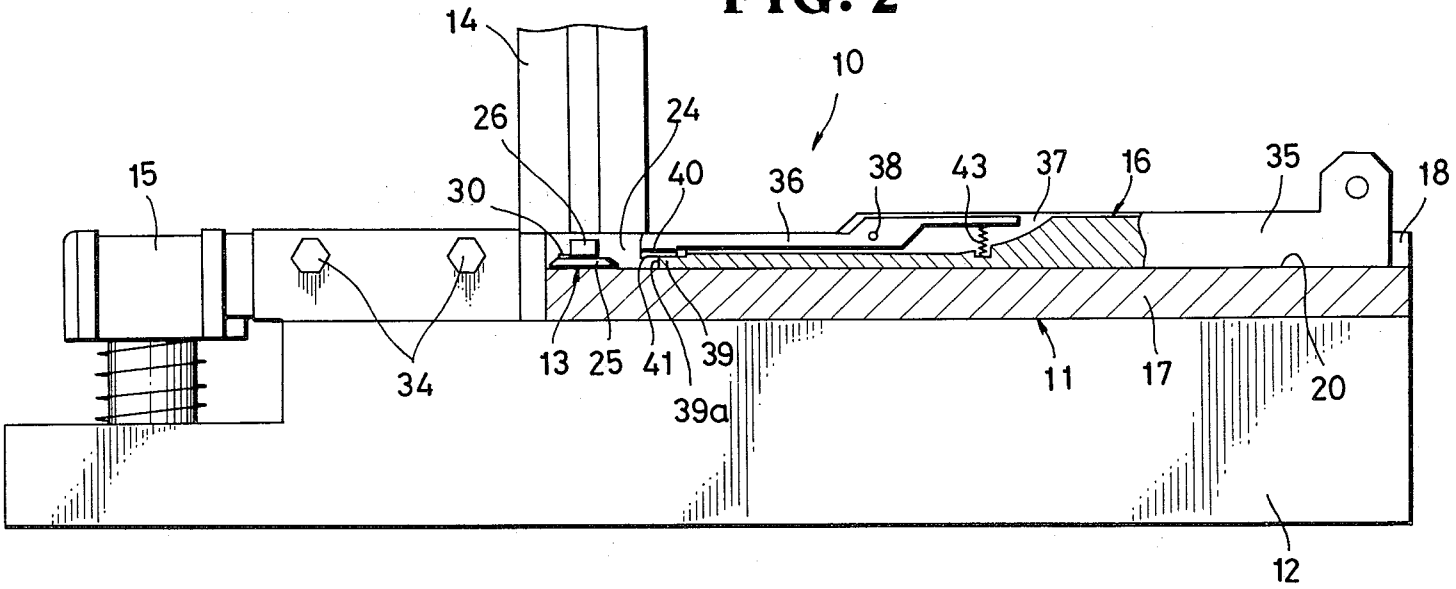
FIG. 2 is a side elevational view, with parts broken away, of the apparatus of FIG. 1.

As shown in FIGS. 1 and 2, a button orienting and placing apparatus 10 generally comprises an elongate horizontal guide 11 mounted on a support 12 for guiding buttons 13 (described below) one at a time from a chute 14 onto a die 15 (described below) disposed contiguous to one end of the guide 11, and a pusher mechanism 16 slidably supported on the guide 11 for pushing the button 13 out of the guide 11 onto the die 15.

The guide 11 includes an elongate base 17 (FIGS. 2, 4 and 5), a pair of first and second parallel side walls 18,19 disposed remotely from the die 15 and jointly defining therebetween a first guide channel 20, a third side wall 21 disposed adjacent to the die 15, and a friction member 22 disposed oppositely to the third side wall 21 so as to define therewith a second guide channel 23 as an extention of the first guide channel 21. The first and second side walls 18,21 are longitudinally spaced apart from one another to provide therebetween an inlet port 24 to which a lower end of the chute 14 is connected. Thus one button 13 having discharged from the chute 14 is introduced into the second guide channel 23 via the inlet port 24.

Figure 6:
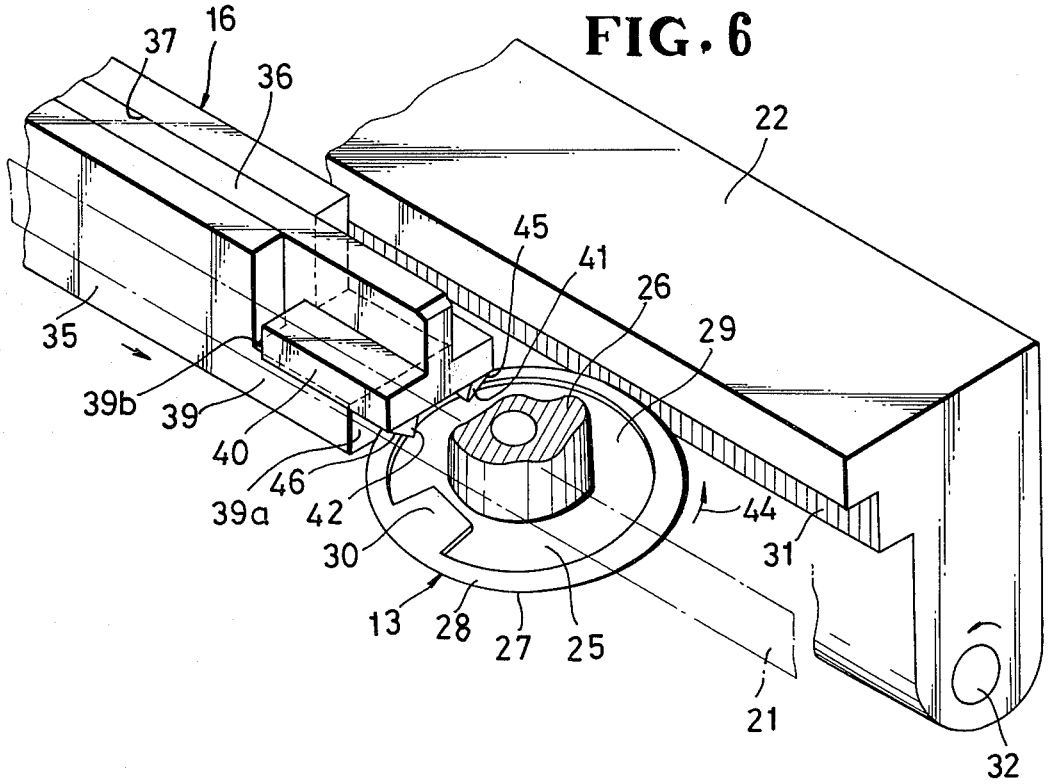
FIG. 6 is an enlarged fragmentary perspective view, with parts broken away, of the apparatus, showing the manner in which a button is oriented.

As best shown in FIG. 6, the button 13 includes a disk-shaped head 25 and a shank 26 projecting centrally from the reverse side of the head 25. The head 25 is covered over the obverse side by a decorative cap 27 bearing a design, mark or symbol (not shown) showing a specified direction in which the button 13 is to be oriented when attached to a garment (not shown). The decorative cap 27 has a rim portion 28 extending around a peripheral edge of the head 25 so as to define with the shank 26 a ring-shaped shallow recess 29, there being a tab 30 projecting radially from the rim portion 28 into the recess 29. The tab 30 is disposed at a predetermined position which corresponds to the specified direction of the non-illustrated design on the decorative cap 27.

The friction member 22 has a notched frictional surface 31 frictionally engageable with the button head 25 on its peripheral edge, i.e. on the rim portion 28 of the decorative cap 27, for a purpose described below. The frictional member 22 is pivotally mounted on a shaft 32 supported by the guide base 27 (FIGS. 2, 4 and 5) and is normally urged by a pair of compression springs 33,33 (FIGS. 1, 3 and 5) to turn counterclockwise (as viewed in FIG. 5). Thus the frictional surface 31 of the friction member 22 is urged against the rim portion 28 of the decorative cap 27 while the button 13 is moved through the second guide channel 23, as described below. The amount of biasing force of each compression spring 33 may be adjusted by turning a screw 34 (FIGS. 1, 3 and 5).

The pusher mechanism 16, as shown in FIGS. 1, 2 and 6, includes an elongate, button pushing slide 35 slidably received in the combined guide channel 20,23 of the guide 11, and a locking lever 36 pivotally mounted in a longitudinal cavity 37 of the slide 35 by a pin 38. The pushing slide 35 has a stepped front end portion 39 engageable at its tip end 39*a* (FIGS. 2, 4 and 6) with the button head 25 on its peripheral edge. The locking lever 36 has a flanged front end portion 40 extending beyond the stepped end portion 39 and terminating in a pair of downwardly directed claws 41,42 for catching therebetween the tab 30 of the button 13 in a manner described below. A compression spring 43 (FIG. 2) is mounted between the slide 35 and the locking lever 36 to urge the latter to turn counterclockwise in FIG. 2; the flanged end portion 40 of the locking lever 36 is thus urged against the stepped end portion 39 of the pushing slide 35. Such downward movement of the flanged end portion 40 is restricted by the upper surface 39*b* (FIG. 6) of the stepped end portion 39 so as to prevent the button head 25 from being excessively pressed and thus tilted by the flanged end portion 40. The pushing slide 35 is operatively connected to a suitable drive means (not shown) for linear movement through the combined guide channel 20,23 between a first position (solid lines in FIGS. 1 and 2) in which both the pushing slide 35 and the locking lever 36 are retracted out of the second guide channel 23 into the first guide channel 20 for allowing the button 13 to be introduced into the second guide channel 23 via the inlet port 24, and a second position (broken lines in FIG. 1) in which both the pushing slide 35 and the locking lever 36 project through the second guide channel 23 for pushing the button 13 out of the second guide channel 23 onto the die 15.

Figure 3:
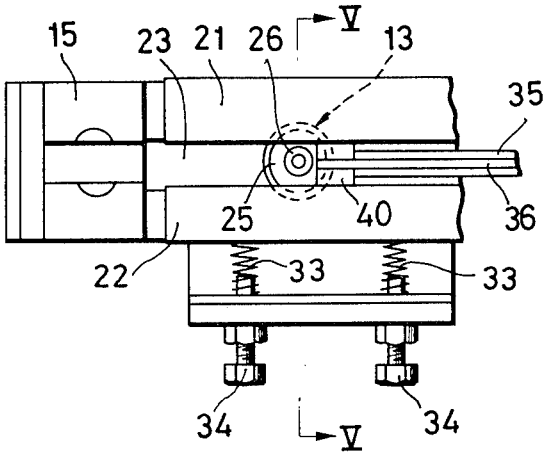
FIG. 3 is a fragmentary plan view of the apparatus, showing a button being pushed by a pusher mechanism.
Figure 4:
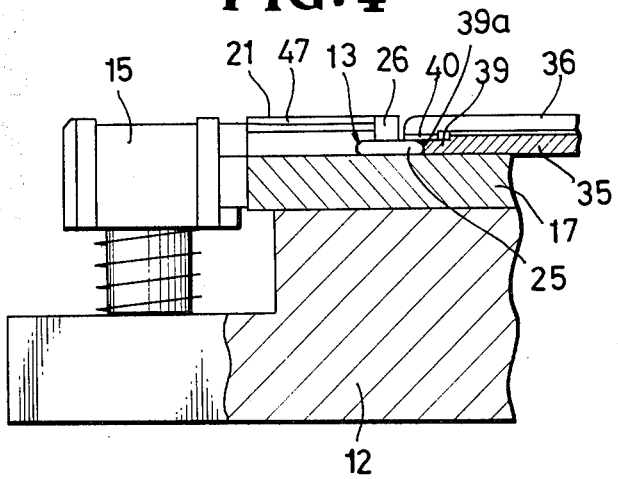
FIG. 4 is a fragmentary side elevational view corresponding to FIG. 3, with parts broken away.
Figure 5:
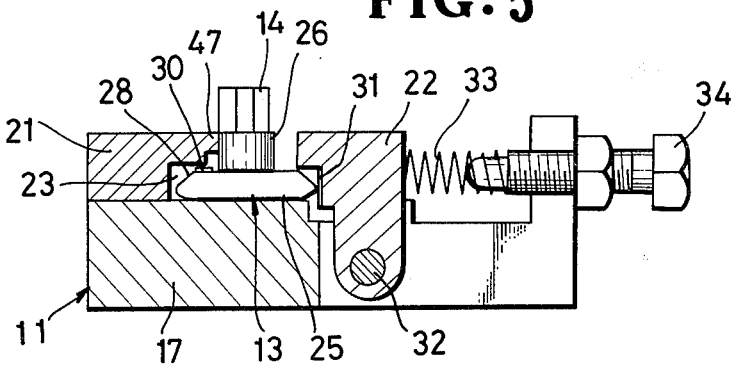
FIG. 5 is an enlarged cross-sectional view taken along line V—V of FIG. 3.

When the button 13 is pushed in the second guide channel 23 (FIGS. 1 and 3–5) toward the die 15 by the tip end 39*a* of the pushing slide 35, the button 13 turns in the direction indicated by an arrow 44 in FIG. 6 because of the frictional surface 31 of the friction member 22 until the tab 30 is caught by the pair of claws 41,42 of the locking lever 36 as shown in FIGS. 3 and 4. The pair of claws 41,42 has a pair of convergent outer side surfaces 45,46, respectively, so that the tab 30 is received between the two claws 41,42 in a snap action; one of the claws 41 rides over the tab 30 against the biasing force of the spring 43 (FIG. 2), and then the other claw 42 blocks the tab 30. After having thus been caught, the button 13 slides rather than rolls on the frictional surface 31 of the friction member 22. Thus the button 13 is oriented (FIGS. 3 and 4).

With continued forward (leftward in FIGS. 3 and 4) movement of the pushing slide 35 together with the locking lever 36, the button 13 is pushed out of the second guide channel 23 onto the die 15. As a result, the button 13 has been placed on the die 15, which coacts with a punch (not shown) to attach the button 13 to a garment (not shown) disposed between the die 13 and the punch as is well known in the art.

The third side wall 21 has an inwardly directed flange 47 which is engageable with the shank 26 of the button 13 while the latter is being moved in the second guide channel 23. During that time, the frictional surface 31 of the friction member 22 is tangentially engageable with the rim portion 28 of the decorative cap 27 in such a manner that the frictional surface 31 lies at a right angle to the general plane of the disk-shaped head 25 of the button 13, as shown in FIG. 5.

According to the present invention, the button 13 is pushed on the peripheral edge of the head 25 by the tip end 39*a* of the pushing slide 35, and therefore, the button 13 can be moved through the second guide channel 23 smoothly without being forwardly tilted. Further, since the friction member 22 presses the button 13 on the peripheral edge of the head 25 (the rim portion 28 of the decorative cap 27) so as to urge the shank 26 against the flange 47 of the third side wall 21, it is possible to reduce the resistance to turning of the button 13 to a minimum. This reduced resistance causes smooth rolling of the button 13 in the second guide channel 23 as the button 13 is pushed by the pushing mechanism 16, thus effecting easy and exact orientation of the button 13.

In addition, because the friction member 22 is pivotally mounted on the shaft 32 that is parallel to the third side wall 21, there is no danger that the frictional surface 31 is tilted with respect to the longitudinal axis of the second guide channel 23, thus giving the button 13 a uniform degree of pressing force along the full length of the friction member 22.

It will be understood that various changes in the details, material, and arrangements of parts, which have been herein described and illustrated in order to explain the nature of the invention, may be made by those skilled in the art within the principle and scope of the invention as expressed in the appended claims.

What is claimed is:

1. An apparatus for orienting and placing a button for attachment to a garment, the button including a disk-shaped head, a shank projecting centrally from the reverse side of the head, and a tab disposed on the reverse side of the head and extending radially thereof, said apparatus comprising:

(a) a guide having a side wall and a friction member disposed oppositely to said side wall to define therewith a guide channel for guiding therethrough the button;

(b) a pusher mechanism for pushing the button through and out of said guide channel, said pusher mechanism including (1) a button pushing slide slidably supported on said guide and having a stepped end portion engageable at its tip end with the head of the button on its peripheral edge, (2) a locking lever pivotally mounted on said pushing slide and having a flanged end portion extending beyond said stepped end portion of said pushing slide and terminating in a pair of downwardly directed claws for catching therebetween the tab of the button, (3) means urging said locking lever to cause said flanged end portion to engage said stepped end portion of said pushing slide, and (4) said pushing slide being movable between a first position in which both said pushing slide and said locking lever are retracted out of said guide channel for allowing the button to be introduced into said guide channel, and a second position in which both said pushing slide and said locking lever project through said guide channel for pushing the button out of said guide channel; and (c) said side wall having an inwardly directed flange engageable with the shank of the button in said guide channel, said friction member having a frictional surface frictionally engageable with the head of the button on the peripheral edge thereof for causing the button to roll, when the latter is pushed by said pushing lever in said guide channel, until the tab of the button is catched by said claws.

2. An apparatus according to claim 1, said friction member being pivotally mounted on said guide and normally urged to cause said frictional surface to press the button head on the peripheral edge thereof.

3. An apparatus according to claim 1, said frictional surface being tangentially engageable with the head of the button at a right angle to the general plane of the button head.

* * * * *